US005941031A

United States Patent [19]

Fullwood

[11] Patent Number: 5,941,031

[45] Date of Patent: Aug. 24, 1999

[54] SHUTTER SYSTEM AND METHOD

[75] Inventor: James Fullwood, Tequesta, Fla.

[73] Assignee: Duraframe Window Shutter Systems, Inc., West Palm Beach, Fla.

[21] Appl. No.: 08/756,988

[22] Filed: Nov. 26, 1996

Related U.S. Application Data

[63] Continuation-in-part of application No. 08/328,197, Oct. 24, 1994, Pat. No. 5,465,537, application No. 08/505,006, Jul. 21, 1995, Pat. No. 5,509,239, application No. 08/503,767, Jul. 18, 1995, Pat. No. 5,522,190, application No. 08/504,411, Jul. 20, 1995, Pat. No. 5,524,403, application No. 08/326,995, Oct. 21, 1994, abandoned, and application No. 08/655,811, May 31, 1996.

[51] Int. Cl.[6] ..... E06B 3/30; E06B 9/02; E06B 5/00

[52] U.S. Cl. ..... 52/202; 52/204.62; 52/656.6

[58] Field of Search ..... 52/202, 204.597, 52/204.62, 204.67, 656.5, 656.6, 656.7, 717.01, 203

[56] References Cited

U.S. PATENT DOCUMENTS 3,203,053 8/1965 Lane et al. .
3,991,806 11/1976 Abell .
4,333,284 6/1982 Meadows .
4,891,920 1/1990 Pingston .
5,603,190 2/1997 Sanford ..... 52/202
5,857,298 1/1999 Fullwood ..... 52/202

*Primary Examiner*—Robert Canfield
*Attorney, Agent, or Firm*—Rosenberg, Klein & Bilker

[57] ABSTRACT

Eliminating a header and a footer as well as side mounts around a shutter system as original construction or retrofit by providing a frame structure which preselectively frames the enclosure and at its inner portion contains a frame mounting plate and a centerless thread former at one edge of the mounting plate oriented to be in close proximity to the opening in the enclosure is disclosed. Yet another feature of the present invention relates to the mounting of a composite panel or, indeed, shutter panels by which an insert receives a mounting bolt. The insert has an oblong hole passing through it with a header at one end.

4 Claims, 5 Drawing Sheets

SHUTTER SYSTEM AND METHOD

CROSS-REFERENCE TO RELATED PATENTS AND APPLICATIONS

The present application is a continuation-in-part of those applications resulting in U.S. Pat. Nos. 5,465,537 filed Ser. No. 08/328,197, Oct. 24, 1994; 5,509,239 filed Ser. No. 08/505,006, Jul. 21, 1995; 5,522,190 filed Ser. No. 08/503,767, Jul. 18, 1995; and 5,524,403 filed Ser. No. 08/504,411, Jul. 20, 1995. This application is also a continuation-in-part of Ser. No. 08/326,995 filed Oct. 21, 1994, now abandoned; and application Ser. No. 08/655,811, filed May 31, 1996, said application still pending, all by the same inventor herein.

FIELD OF THE INVENTION

The present invention relates to shutter systems normally provided over openings in building enclosures to shield against hurricanes and other natural disaster-type storms.

SUMMARY OF THE PRIOR ART

The invention relates to the type of system shown in applicant's U.S. Pat. Nos. 5,465,537; 5,509,239; 5,522,190; and 5,524,403. Such systems normally employ a plurality of panels, or a single panel, which are secured to cover the opening in the building by removable securable members. Also to be mentioned are U.S. patent application Ser. Nos. 08/148,792, filed Oct. 29, 1993; 08/326,995, filed Oct. 21, 1994; and Ser. No. 08/655,811, filed May 31, 1996, all of which are parent applications for the present continuation-in-part application.

One of the problems with shuttering systems is the header or footer or more particularly expressed, the mounting assembly. In the traditional prior art threaded members are sunk into the wall portion of the enclosure. The shutters are then provided with holes around their top, bottom, and lateral edges. Removable securing means such as bolts or thumb screws secure the shutter panel to the structure itself. This creates a significant disadvantage for the installer as well as the user since there is fair amount of play, particularly when panels are employed, in the dimensioning of locating the threaded embedded members and thereafter screwing the removable securable members in place. In addition, where headers and footers are employed, they create a permanent unsightly eyebrow/mustache relationship with the window or whatever the enclosure may be.

SUMMARY OF THE INVENTION

The present invention is addressed to eliminating a header and a footer as well as side mounts around a shutter system by providing a frame structure which frames the enclosure and at its inner portion contains a frame mounting plate and a centerless thread former at one edge of the mounting plate oriented to be in close proximity to the opening in the enclosure. The advantage of the present invention is that the frame can be secured to an existing dwelling as a retrofit or can be utilized in new construction. It can also be utilized to employ trim; or in the new construction it can be secured to the wall and covered with the stucco when the building is completed and, therefore, require no trim. Yet another feature of the present invention relates to the mounting of a composite panel or, indeed, shutter panels by which an insert receives a mounting bolt. The insert has an oblong hole passing through it with a header at one end. The insert transfers the load from a threaded bolt or other securing means to a much larger surface in the hole in the shutter panel thereby significantly increasing the resistance to flexure and other types of testing employed in connection with such stringent tests as are involved with Dade County approval of shutter systems. Moreover, the oblong hole has its long axis perpendicular to the centerless thread thereby providing centering tolerances along two axes.

In view of the foregoing it is a principal object of the present invention to provide a frame shutter system which can be positioned as original equipment when the dwelling is built, or in a modified embodiment, put in place as a retrofit.

Yet another object of the present invention is to provide for positioning a frame structure in place around an enclosure opening and thereafter easily securing a trim portion to it thereby almost totally masking the existence of the frame.

Yet another and very important object of the present invention is to provide a frame with a centerless thread receiving groove running around the entire periphery of the enclosures so that when a bolt or thumb screw or other threaded member is to be the securing element for the shutter panel, there is no need to locate the center with precision.

A further object of the present invention, in addition to assisting the centerless mounting of the removable securable element is the provision of the insert with the oblong hole to provide a modified centerless opening perpendicular to the centerless opening in the frame which, therefore, gives a tolerance in both the "X" and "Y" directions when a threaded or other removable securable member is being secured to the shutter system.

BRIEF DESCRIPTION OF THE ILLUSTRATIVE DRAWINGS

The present invention will be more fully understood taken in conjunction with the accompanying illustrative drawings, in which.

Figure 6:
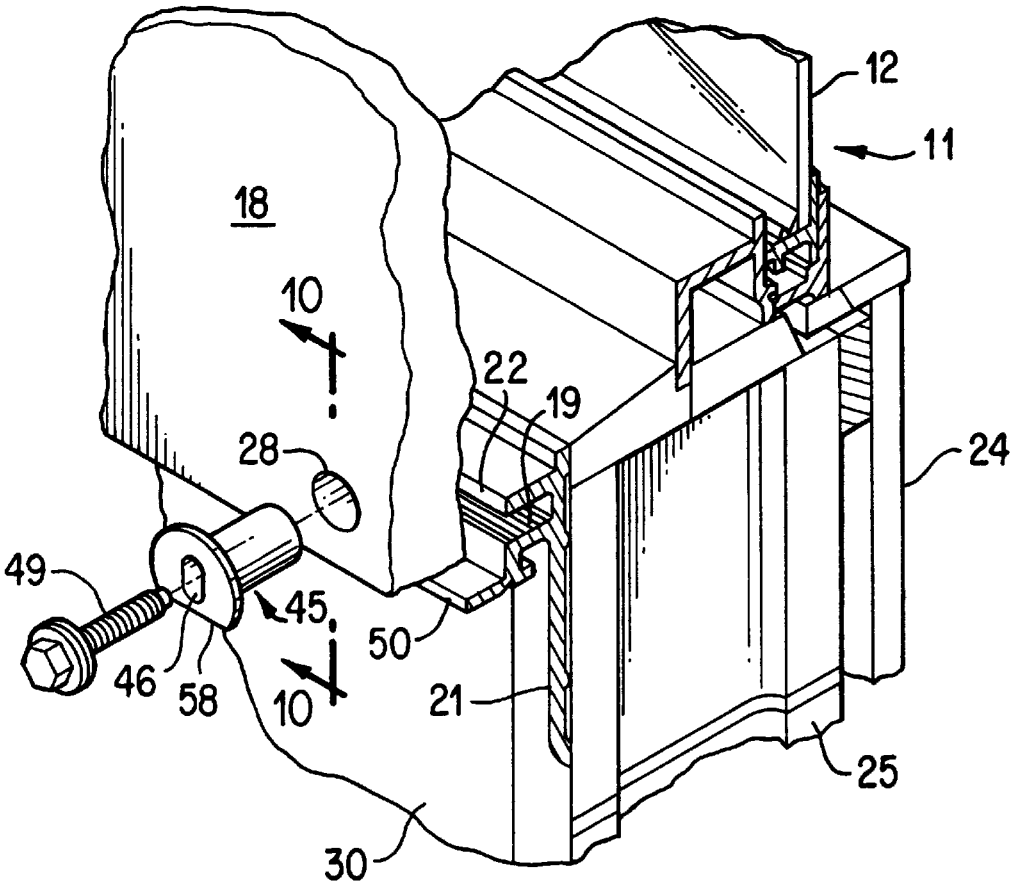
Figure 7:
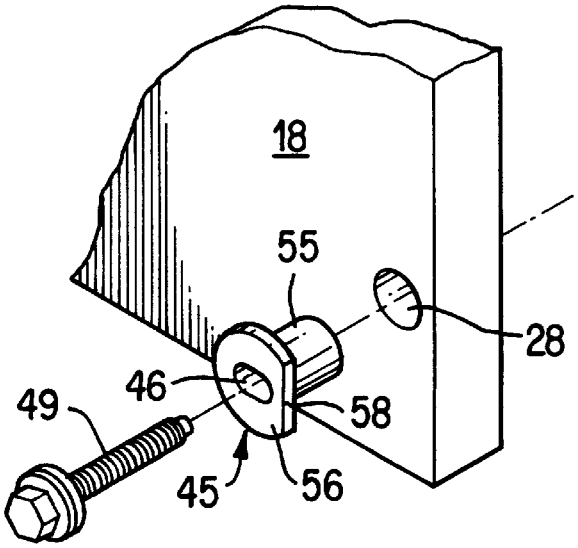
Figure 8:
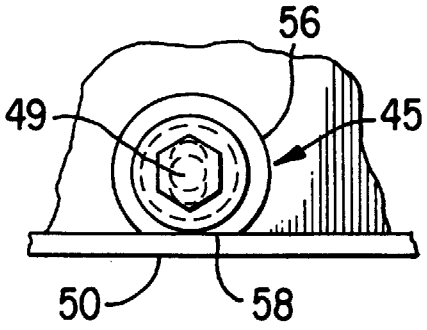
Figure 9:
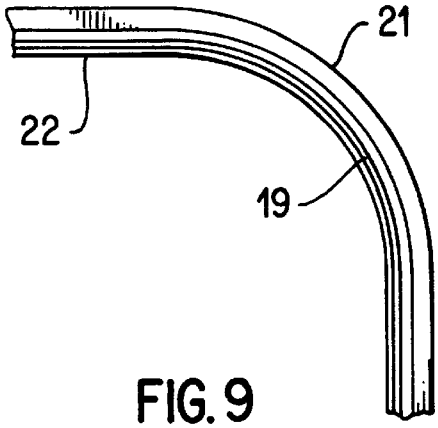
Figure 11:
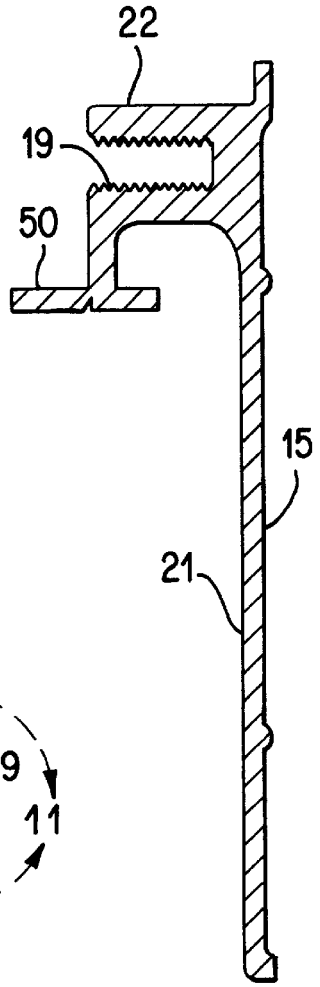
Figure 10:
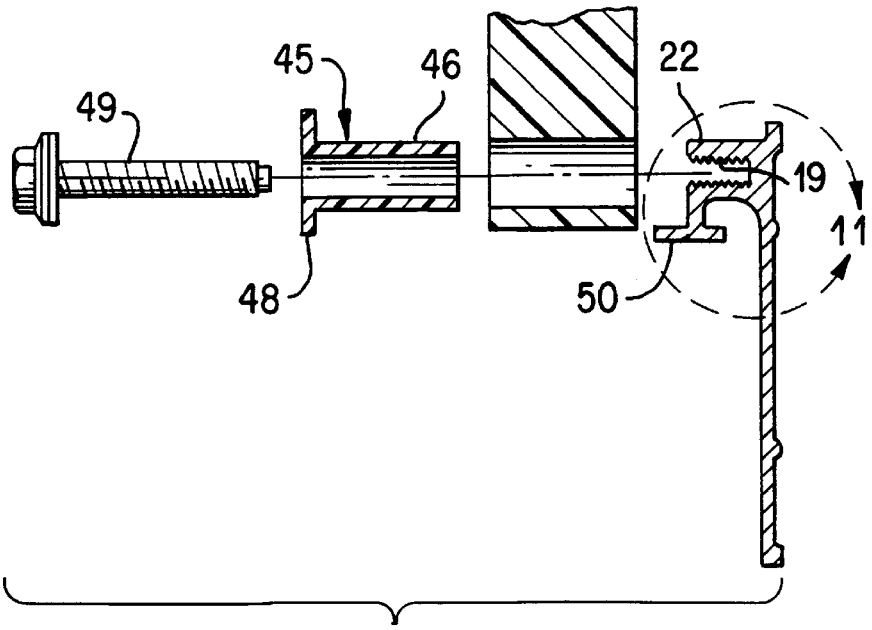
Figure 12:
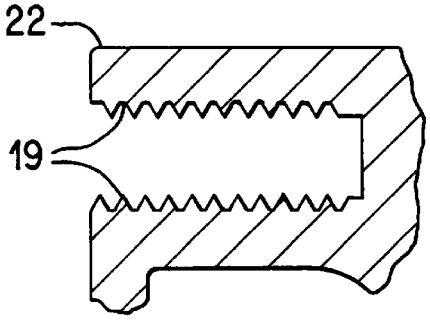

FIG. 6 is an alternative embodiment of the frame structure which has been mounted in place prior to completing the building and thereafter the stucco is placed over the frame. Provision is made in this construction for an insert ledge which engages a flat on the mounting insert to thereby orient the insert with the oblong recess positioned perpendicular to the centerless thread thus giving both "X" and "Y" play for the insertion of the removable securable member;

FIG. 7 is an enlarged partially diagrammatic view showing how the insert passes through a hole in a shutter panel and thereafter the bolt is secured in place;

FIG. 8 is a front elevation of the insert and bolt as shown in FIG. 7 but in the final orientation and illustrating the relationship between the two and the mounting ledge portion of the frame;

FIG. 9 is a reduced scale version of the frame illustrating how it can be bent around a radius close to one foot to thereby secure the upper portion of a unitary panel to a window or other enclosure which is semi-circular or curvilinear at the top;

FIG. 10 is an enlarged exploded transverse view taken along section line 10—10 of FIG. 6;

FIG. 11 is yet a further enlarged view of the frame section shown in the bulls eye 11 in FIG. 10; and FIG. 12 is yet a further enlarged view of the thread profile shown previously in FIGS. 10 and 11 illustrating the opposed relationship between the ridges and the grooves in the centerless longitudinal slot.

DESCRIPTION OF A PREFERRED EMBODIMENT

As this description proceeds taken in conjunction with the drawings in FIGS. 1–12, it will be noted that common reference numerals are employed even though the shape of the part may differ. For example, where the sill has an inner sill 34 and an outer sill 35 as shown in FIGS. 2–6 the same reference numeral is employed. Similarly where a concrete block 25 is shown in various embodiments, that reference numeral remains common. As to the plywood, firring strips, and stucco, the same applies.

Figure 1:
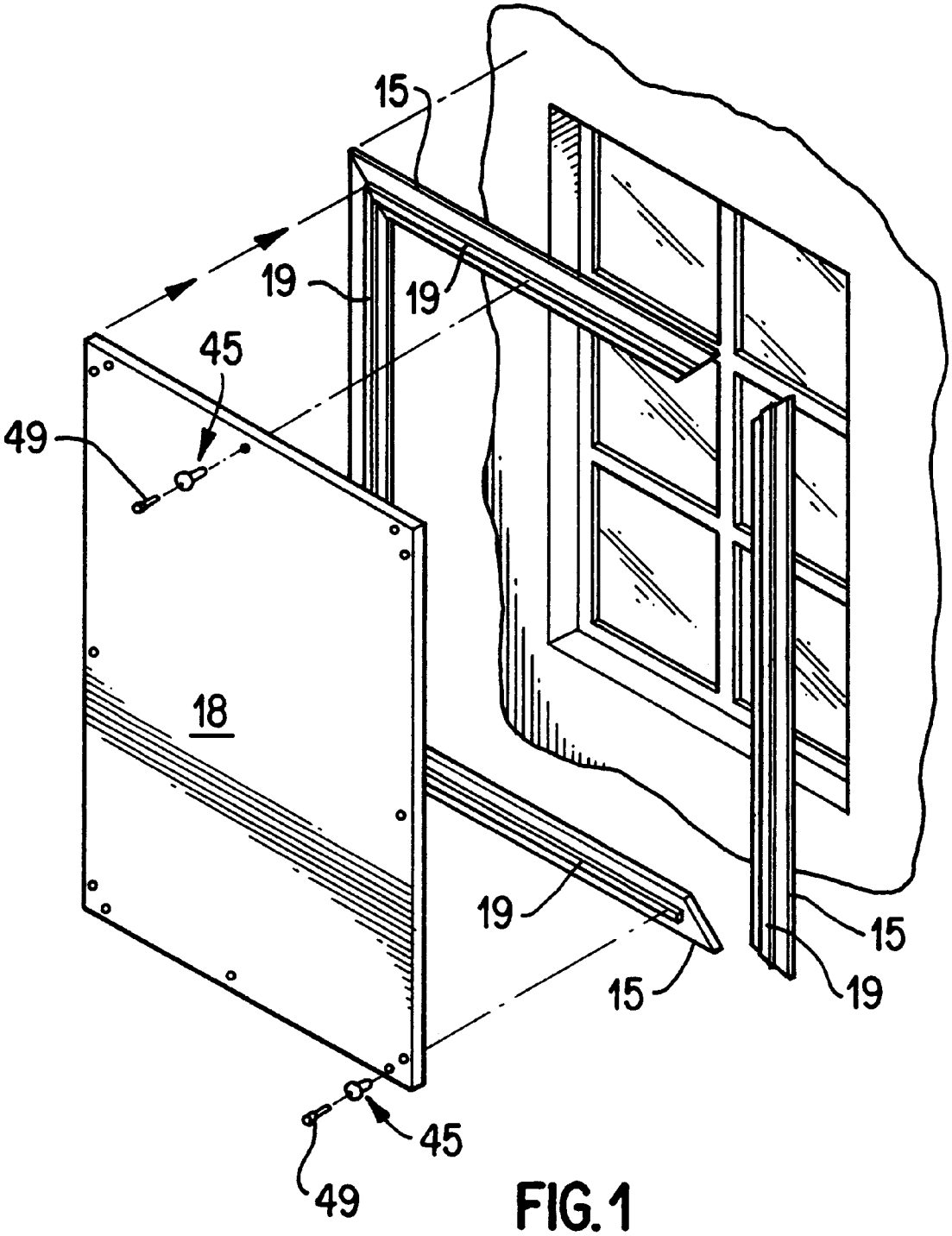
FIG. 1 is an exploded perspective view of the frame system illustrative of the present invention showing the shutter, frame, and trim in exploded form.
Figure 2:
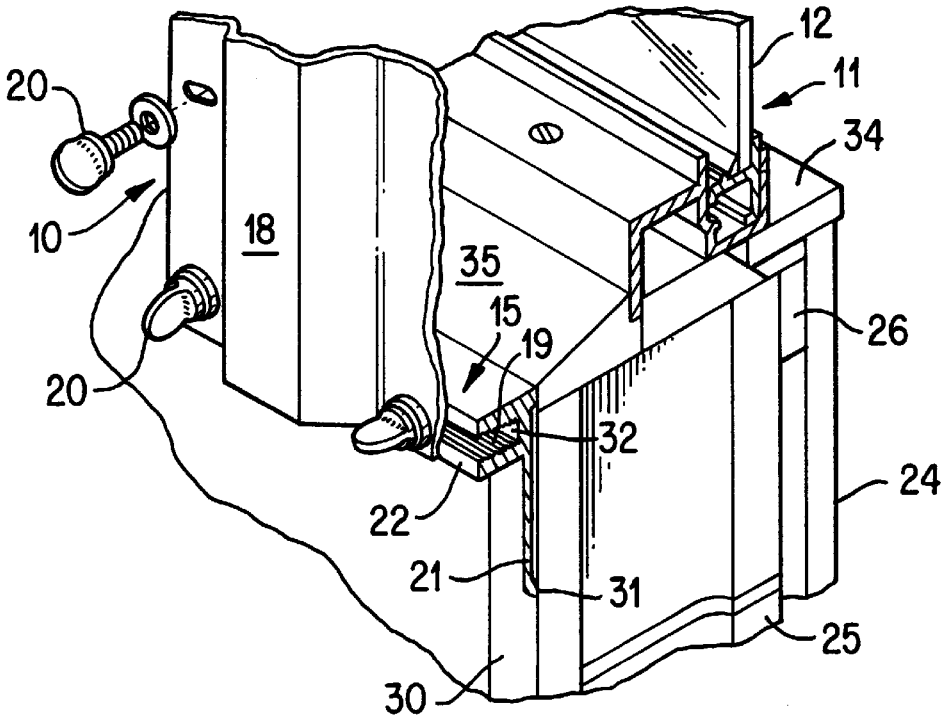
FIG. 2 is an enlarged partially broken perspective view of a frame structure surrounding a concrete block wall in which the stucco on the wall is placed over the frame as the construction is built.

To be noted in FIG. 1, the shutter system 10 is illustrated as prepared to overlie a window opening 11 which, in turn, has an internal window. The frame 15 is ideally positioned in surrounding relationship to the window opening 1, and optionally provision is made for trim to be secured to the frame. The frame may also be on any preselected side, top, or bottom of such an opening. The shutter panel 18 is secured to a centerless thread 19 in the thread forming portion at the edge of the enclosure and preferably secured by means of a threaded fastener. While other forms of removable securement are contemplated, the most practical one found to date is the thread on the #20 ¼-inch mounting bolt, and the offset grooves provided interiorly of the frame 15. As shown in FIG. 2, the frame member 15 has a thread former 22 at the interior edge extending from the mounting plate 21 and contains a centerless thread 19 made up of opposed ridges and grooves. Ideally, the opposed ridges and grooves are opposite each other to therefore provide a linear receipt for a helical thread on the mounting fastener 20.

Figure 3:
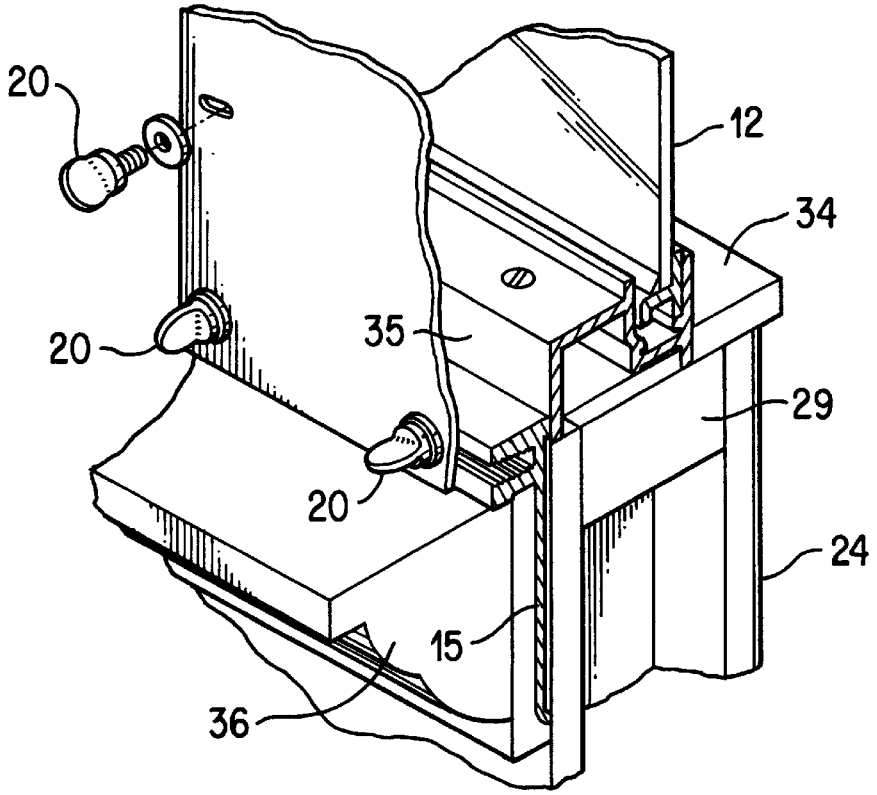
FIG. 3 is a modified view of that shown in FIG. 2, where plywood has been employed as the building structure, and where the frame has been mounted as a retrofit, and the frame provided with a trim.

The various structures employed utilize concrete block 25 and drywall 24 with fir strips 26 as shown in FIG. 2. In FIG. 3, of course, a 2×4 wooden frame member 29 is employed in the structure rather than a concrete block. This structure could be for an interior window and such is contemplated where the interior window may be in a patio area that still requires protection.

The mounting hole 28 shown in FIG. 6 is employed primarily where there is a single monolithic panel. Alternatively, a corrugated panel 18, such as shown in FIG. 2, may have lateral mounting holes as well as those on the horizontal portion. More specifically, it should be noted in FIG. 2 that the mounting plate 21 desirably includes a plate offset 31 at its lower portion and a thread former offset 22 at its upper portion to permit threadedly engaging the same against the wall such as shown in FIG. 6.

The window is trimmed out by means of an inner sill 34 and an outer sill 35 and, as mentioned earlier, trim 36 such as illustrated in FIGS. 3 and 5 are contemplated. The trim alternatives 40, 41 shown in FIG. 5 snap-fittingly engage opposed recesses 3 provided in the frame as shown. The opposed recesses 37 for mounting trim 40, 41 are optional and not present in FIGS. 2–4. This is a further optional construction of the frame 15 itself.

Turning now to FIG. 6 it will be seen that yet another embodiment exists where the mounting is to be made with an insert 45 through the hole 28 in the composite panel 18. The insert 45 has an oblong penetrating hole 46, the long axis of which is mounted perpendicular to the longitudinal axis of the centerless thread 19 of the frame member 15 thus permitting the bolt 49 to shift in two directions while it is being activated to threadedly secure the insert 45 into the hole 28 of the panel 18. Also an orienting flat 58 is provided on the insert which, as shown in FIGS. 7 and 8 particularly, engages the insert ledge 50 thereby locking the insert against rotation and in addition and most importantly securing the same so that the long axis of the oblong hole 46 is perpendicular to the longitudinal axis of the centerless thread 19 thereby providing for fastener freedom of movement along the centerless thread 19, and flexibility along the axis perpendicular to the centerless thread 19. Not only does the insert 45 facilitate ease in mounting, but in testing where a flex action and vibratory action is involved, it significantly reduces the possibility of the bolt 48 tearing through the sidewall of the hole 28. Thus, the insert provides major flexibility in mounting, and significant upgrading in strength, particularly where dynamic loading is involved. With a hurricane, it is a given that the loading is dynamic and it varies, and that in combination with the configuration of the exterior of the building, or the configuration of the shutter panel 18, provides for instability, which instability is offset by the insert and particularly by the insert's ability to translate the tangential point contact of the bolt 49 into cylindrical intimate contact between the shank 55 of the insert and the interior portion of the hole 28. Moreover, the insert head 56 provides for further transmission of the force of the bolt in its secured relationship to uniformly engage the panel 18 and its hole 28. Further details of the invention appear in FIGS. 7 and 8 showing how the flat 58 on the insert engages the frame structure. This appears particularly in FIGS. 7 and 8, but is further illustrated in FIG. 10, a longitudinal view. The freedom of adjustment is best illustrated in FIG. 11 when it is realized that the centerless thread 19 shown at the right is essentially endless in one direction, and yet the oblong 46 in the insert 45 is, in the vertical direction, considerably longer than the shank of the bolt 49. The flat 48 on the insert as shown in FIG. 10 fits on top of the insert ledge 50 which insert ledge 50 is shown in both FIGS. 10 and 11.

By way of specifics, the centerless thread 19, in a typical embodiment for a one-quarter inch number 20 bolt, is shown in FIG. 12. There it will be seen that the section which has the centerless thread is one-half inch thick and the threaded hole is approximately 0.6 inches in depth. The thread itself is cut to a depth of one-quarter inch with the ridges at approximately two-tenths of an inch on center. Between the top and the bottom the ridges and the grooves match each other but with a tolerance of seven to eight thousandths per inch. The distance from ridge-to-ridge or groove-to-groove is 0.050 inches. The included angle between the adjacent threaded members is approximately 64°. The aluminum for the frame 15 is known as 6063-T6 alloy. It is normally painted or anodized. The flat as shown in FIG. 11 can vary from two to six inches in width with the ridges at both the top and the bottom on the inner face varies normally 0.080 inches. In the embodiments designed for receiving the insert 45, a ledge 50 is provided at the portion of the frame extreme from the centerless groove 19.

Materials Employed

The materials employed for the frame itself are aluminum with good extrusion and strength characteristics such as alloy 6063 -T6 which is a hard alloy. Softer alloys are less desirable. The shutter panels may be of the corrugated variety or of a composite such as shown in prior patent application Ser. No. 08/655,811 filed May 31, 1996. In addition thereto, other panel materials such as corrugated or even plywood can be adapted for this system. The bolt employed is generally known as a quarter inch machine bolt with a hex-head and an integral washer. The recommended length of the bolt is determined by the thickness of the panel and depth of the centerless thread. The material for the insert 45 is natural nylon.

The Method

The method of the present invention is directed primarily to the provision of a frame type structure for surrounding a closure which will provide a centerless thread throughout the entire effective securement engaging portion of the perimeter of the enclosure. In addition, the method contemplates providing holes in a composite panel which are dimensioned to be penetrated by an insert having an oblong-type central bore. Moreover, the method is importantly directed to orienting the insert oblong broad to be essentially perpendicular to the endless thread 19. Thus, as shown in FIG. 7, it will be seen that the insert 45 is intended to be rotated as shown in the arrow after it is inserted into the hole 28 in the panel 18. The method also provides for forming means on the head of the insert 45 such as flat 58 which, in turn, coacts with the insert ledge 50 provided on the frame member 15.

Figure 4:
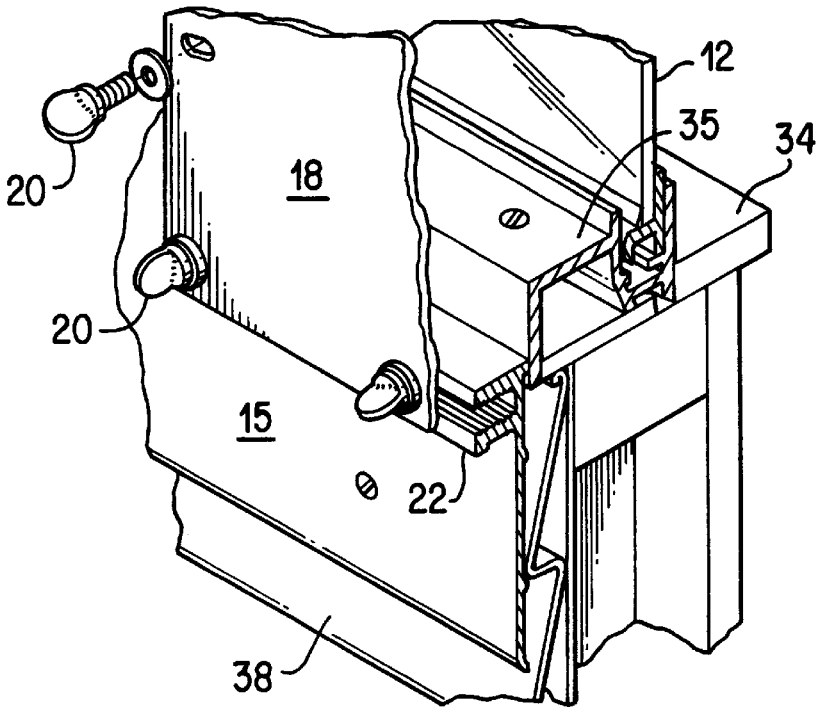
FIG. 4 is yet another alternative embodiment of the frame showing the same as trimming out over aluminum or plastic siding.
Figure 5:
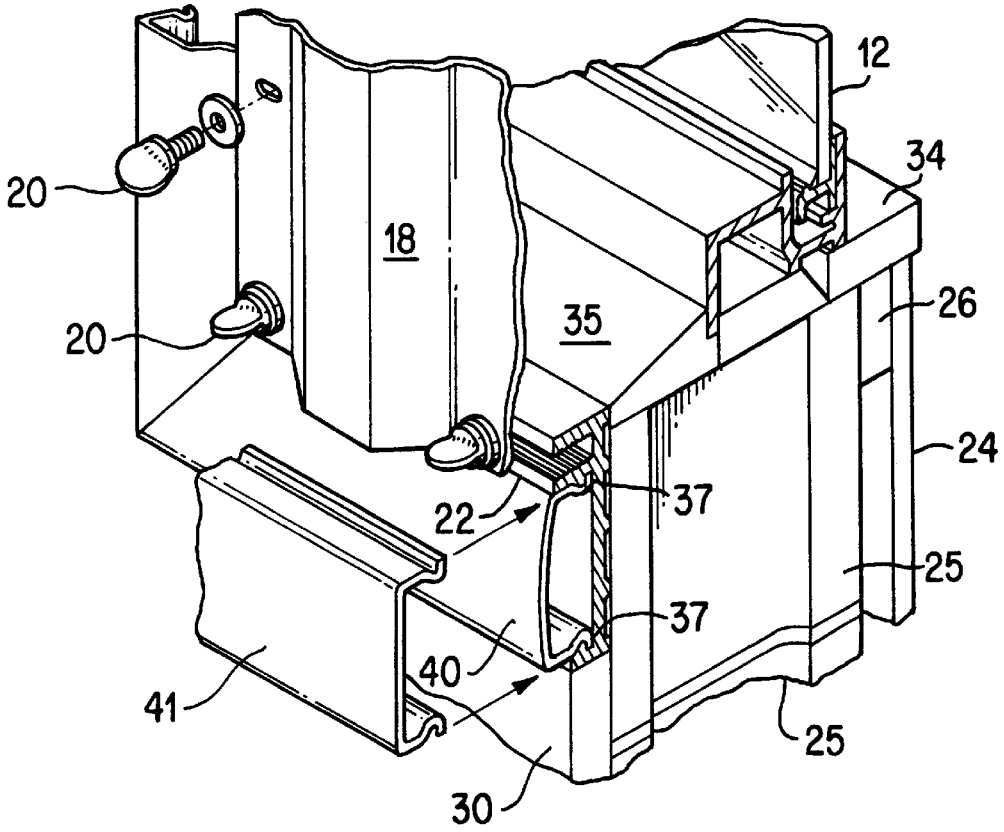
FIG. 5 is yet another embodiment disclosing the utilization of a frame on a concrete block structure in which it has been applied above the exterior stucco, and provision is made for inserting trim, as presently shown two alternative embodiments of the trim are present.

The method is applicable to securing the frame in place on a house under construction and thereafter applying the stucco 30 as shown in FIG. 6 and also in FIG. 2. On the other hand, the frame 15 can be applied to a structure as a retrofit such as shown in FIGS. 3–5. In FIG. 5, the method includes forming the wall and stuccoing the same so that there is a recess against the concrete block 25 to receive the frame 15. Finally, the method also contemplates securing molding to the mounting plate portion of the frame in various configurations.

The Method of Curving

A further aspect of the present invention derives from the form, proportion, and material of the metal for the frame, but in addition permits curving the same to a radius of less than ten inches or alternatively an arch with a twenty inch span or more. This is to normally accommodate the upper portion of a shutter closure system where an arch is in the opening.

In order to form the radius the following steps are undertaken:

1. The metal is alloy 6063-T4.
2. Once bent, the alloy is heat treated to a T6 alloy.
3. Thereafter, the curved frame is annodized or painted to the desired color.

It will be understood that various changes in the details, materials and arrangements of parts which have been herein described and illustrated in order to explain the nature of the invention, say be made by those skilled in the art within the principle and scope of the invention as expressed in the appended claims.

What is claimed is:

1. A storm shutter system covering an opening in a building structure, the building structure having a weatherside, said storm shutter system comprising:

a frame forming member secured to said weatherside of said building structure in surrounding relationship with said opening, a rigid shutter panel removably secured to said frame forming member to protect said opening from unwanted outside forces, said rigid shutter panel having a plurality of protruding insert structures spaced apart along perimeter thereof, and a plurality of removable retaining means:

said frame forming member including an elongate strip constituting a base mounting plate affixed to said building structure, and a thread forming member extending along one edge of the mounting plate, said thread forming member including:

a pair of spaced apart legs extending outwardly from said base mounting plate at said one edge thereof and forming a centerless thread having a U-shaped channel extending along said thread forming member, said legs having outward edges, and a plurality of longitudinal grooves and ridges extending internally along said U-shaped channel and proportioned to receive said removable retaining means, each of said removable retaining means protruding through a respective one of said spaced apart protruding insert structures at said rigid shutter panel and each threadingly engaging said longitudinal grooves and ridges in said thread forming member, thereby removably securing said rigid shutter panel to said frame forming member at said outward edges of said legs.

2. The storm shutter system, further including a trim member, an abutment receiving said trim member, said abutment extending in perpendicular to the base mounting plate spaced from said legs, and means securing said trim member to said base mounting plate.

3. The storm shutter system of claim 1, further including a trim member having lateral edges, and wherein said base mounting plate further includes opposed grooves engaging the lateral edges of said trim member.

4. A storm shutter system, comprising:

an extruded frame member disposed in a preselected relationship to an enclosure structural opening, said frame member including a single F-shaped member formed with a flat mounting plate portion and two endless groove forming legs having outward edges and perpendicular to said mounting plate and extending at an edge thereof, said legs forming a U-shaped channel, and a plurality of receiving means interiorly of the U-shaped channel;

a rigid shutter panel removably secured to said extruded frame member, said rigid shutter panel having a plurality of protruding insert structures spaced apart along perimeter thereof; and a plurality of threaded fasteners, each protruding through a respective one of said protruding insert structures of said rigid shutter panel and threadingly engaged within said U-shaped channel, thereby securing said rigid shutter panel to said outward edges of said endless groove forming legs.

* * * * *